US005404208A

United States Patent [19]

Edmunds

[11] Patent Number: 5,404,208

[45] Date of Patent: Apr. 4, 1995

[54] MODULATED WIRE AC SCAVENGELESS DEVELOPMENT

[75] Inventor: Cyril G. Edmunds, Webster, N.Y.

[73] Assignee: Xerox Corporation, Stamford, Conn.

[21] Appl. No.: 188,860

[22] Filed: Jan. 31, 1994

[51] Int. Cl.[6] ..... G03G 15/08

[52] U.S. Cl. ..... 355/247; 118/654

[58] Field of Search ..... 355/247, 249, 259, 261, 355/265, 215; 118/651, 661, 654

[56] References Cited

U.S. PATENT DOCUMENTS

| | | | |
|---|---|---|---|
| 4,797,335 | 1/1989 | Hiratsuka et al. | 355/251 X |
| 4,984,019 | 1/1991 | Folkins | 355/215 |
| 4,994,859 | 2/1991 | Mizuno et al. | 355/247 |
| 5,081,500 | 1/1992 | Snelling | 355/273 |
| 5,124,749 | 6/1992 | Bares | 355/245 |
| 5,144,370 | 9/1992 | Bares | 355/247 |
| 5,144,371 | 9/1992 | Hays | 355/249 |
| 5,153,611 | 10/1992 | Kokado et al. | 355/261 X |
| 5,153,647 | 10/1992 | Barker et al. | 355/245 |
| 5,153,648 | 10/1992 | Lioy et al. | 355/247 |
| 5,157,226 | 10/1992 | Takahashi | 118/651 |
| 5,204,719 | 4/1993 | Bares | 355/247 |
| 5,206,693 | 4/1993 | Folkins | 355/261 |
| 5,233,392 | 8/1993 | Kitamura | 355/261 |
| 5,321,474 | 6/1994 | Bares | 355/247 |

*Primary Examiner*—Robert B. Beatty
*Attorney, Agent, or Firm*—John S. Wagley

[57] ABSTRACT

A developer unit for developing a latent image recorded on an image receiving member with marking particles, to form a developed image. The unit includes a donor member spaced from the image receiving member and adapted to transport marking particles to a development zone adjacent the image receiving member and an electrode positioned in the development zone between the image receiving member and the donor member. The developer unit also includes a biaser for electrically biasing the electrode with an alternating current having a frequency varying with time, so as to minimize natural frequency resonant vibrations of the electrode and to detach marking particles from the donor member forming a cloud of marking particles in the development zone with detached marking particles from the cloud of marking particles developing the latent image.

17 Claims, 3 Drawing Sheets

MODULATED WIRE AC SCAVENGELESS DEVELOPMENT

The present invention relates to a developer apparatus for electrophotographic printing. More specifically, the invention relates to electrode wires as part of a scavengeless development process.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll." The developer roll is typically in the form of a cylindrical sleeve rotating around a fixed assembly of permanent magnets. The carrier beads form chains extending from the surface of the developer roll, and the toner particles are electrostatically attracted to the chains of carrier beads. When the magnetic brush is introduced into a development zone adjacent the electrostatic latent image on a photoreceptor, the electrostatic charge on the photoreceptor will cause the toner particles to be pulled off the carrier beads and onto the photoreceptor. Another known development technique involves a single component developer, that is, a developer which consists entirely of toner. In a common type of single component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a developer roll. In the development zone adjacent the electrostatic latent image on a photoreceptor, the electrostatic charge on the photoreceptor will cause the toner particles to be attracted from the developer roll to the photoreceptor.

An important variation to the general principle of development is the concept of "scavengeless" development. The purpose and function of scavengeless development are described more fully in, for example, U.S. Pat. No. 4,868,600 to Hays et al., U.S. Pat. No. 4,984,019 to Folkins, U.S. Pat. No. 5,010,367 to Hays, or 5,063,875 to Folkins et al. In a scavengeless development system, toner is detached from the donor roll by applying AC electric field to self-spaced electrode structures, commonly in the form of wires positioned in the nip between a donor roll and photoreceptor. This forms a toner powder cloud in the nip and the latent image attracts toner from the powder cloud thereto. Because there is no physical contact between the development apparatus and the photoreceptor, scavengeless development is useful for devices in which different types of toner are supplied onto the same photoreceptor such as in "tri-level"; "recharge, expose and develop"; "highlight"; or "image on image" color xerography.

A typical "hybrid" scavengeless development apparatus includes, within a developer housing, a transport roll, a donor roll, and an electrode structure. The transport roll advances carrier and toner to a loading zone adjacent the donor roll. The transport roll is electrically biased relative to the donor roll, so that the toner is attracted from the carrier to the donor roll. The donor roll advances toner from the loading zone to the development zone adjacent the photoreceptor. In the development zone, i.e., the nip between the donor roll and the photoreceptor, are the wires forming the electrode structure. During development of the latent image on the photoreceptor, the electrode wires are AC-biased relative to the donor roll to detach toner therefrom so as to form a toner powder cloud in the gap between the donor roll and the photoreceptor. The latent image on the photoreceptor attracts toner particles from the powder cloud forming a toner powder image thereon.

Another variation on scavengeless development uses a single component developer material. In a single component scavengeless development, the donor roll and the electrode structure create a toner powder cloud in the same manner as the above-described scavengeless development, but instead of using carrier and toner, only toner is used.

The AC bias establishes an alternating electrostatic field between the wires and the donor roll which is effective in detaching toner from the surface of the donor roller and forming a toner cloud about the wires, the height of the cloud being such as not to be substantially in contact with the photoreceptor.

The wires, based on their length, diameter, tension, and material composition, and to a lesser extent the rigidity of the frame to which they are mounted, have a natural frequency, $V_n$, that can be described by the formula:

$$V_n=(n/21)*(F/\mu)^{\frac{1}{2}}$$

where:

n=number of loops or the harmonic number

I=length of the wire

F=tension of the wire $\mu$=mass per unit length of the wire

If the frequency of the AC bias is the same as the natural frequency of the wires, the wires will excessively vibrate and break. Variations in the length, diameter, tension and material composition of the wires makes it difficult to design wires and AC bias frequencies that avoid the problem of matching the natural frequency. This problem is compounded by the integral multiples of the frequencies or the harmonics.

The following disclosures may be relevant to various aspects of the present invention:

U.S. Pat. No. 5,204,719 Patentee: Bares Issue Date: Apr. 20, 1993

U.S. Pat. No. 5,153,648 Patentee: Lioy et al. Issue Date: Oct. 6, 1992

U.S. Pat. No. 5,153,647 Patentee: Barker et al. Issue Date: Oct. 6, 1992

U.S. Pat. No. 5,144,371 Patentee: Hays Issue Date: Sep. 1, 1992

U.S. Pat. No. 5,144,370 Patentee: Bares Issue Date: Sep. 1, 1992

U.S. Pat. No. 5,124,749 Patentee: Bares Issue Date: Jun. 23, 1992

U.S. Pat. No. 5,081,500 Patentee: Snelling Issue Date: Jan. 4, 1992

U.S. Pat. No. 4,984,019 Patentee: Folkins Issue Date: Jan. 8, 1991

The relevant portions of the foregoing disclosures may be briefly summarized as follows:

U.S. Pat. No. 4,984,019 discloses an apparatus in which contaminants are removed from an electrode positioned between a donor roller and a photoreceptive surface. A magnetic roller is adapted to transport developer material to the donor roller. The electrode is vibrated to remove contaminants therefrom.

U.S. Pat. No. 5,081,500 discloses an electrophotographic device which includes a flexible belt-type sheet of paper or other transfer member into intimate contact with the charge retentive member, bearing a developed latent image and brings a charge retentive surface at a transfer station for electrostatic transfer of toner from the charge retentive surface to the sheet. At the transfer station, a resonator suitable for generating vibratory energy is arranged in line contact with the back side of the charge retentive surface qt the line contact position.

U.S. Pat. No. 5,124,749 discloses an apparatus in which a donor roll advances toner to an electrostatic latent image recorded on a photoconductive member. A plurality of electrode wires are positioned in the space between the donor roll and the photoconductive member. The electrode wires are electrically biased to detach the toner from the donor roll so as to form a toner cloud in the space between the electrode wires and the photoconductive member. Detached toner from the toner cloud develops the latent image. A damping material is coated on a portion of the electrode wires. The damping material damps vibration on the electrode wires.

U.S. Pat. No. 5,144,370 discloses an apparatus in which a donor roll advances toner to an electrostatic latent image recorded on a photoconductive member. A plurality of electrode wires are positioned in the space between the donor roll and the photoconductive member. The electrode wires are tensioned. An electrical bias is applied to the electrode wires to detach the toner from the donor rolls so as to form a toner cloud in the space between the electrode wires and the photoconductive member. Detached toner from the toner cloud develops the latent image. Vibration of the electrode wires is detected in order to enable the vibration of the electrode wires to be substantially cancelled.

U.S. Pat. No. 5,144,371 discloses a scavengeless non interactive development system for use in highlight color imaging. The use of dual frequencies for the AC voltages applied between the wires and donor and donor and image receiver of a scavengeless development system allows for greater gap latitude without degradation of line development.

U.S. Pat. No. 5,153,647 discloses an apparatus which develops an electrostatic latent image recorded on a photoconductive member with toner particles. A donor member is spaced from the photoconductive member and transports toner particles to a development zone adjacent the photoconductive member. Electrode wires are positioned in the development zone between the photoconductive member and the donor member. The electrode wires are electrically biased to detach toner particles from the donor member to form a cloud of toner particles in the development zone. Toner particles detached from the toner particle cloud develop the latent image. The electrode wires are adjustably supported in tension adjacent to the donor member.

U.S. Pat. No. 5,153,648 discloses an apparatus in which a donor roll advances toner to an electrostatic latent image recorded on a photoconductive member. A plurality of electrode wires are positioned in the space between the donor roll and the photoconductive member. A support contacts the electrode wires at at least two points one of the contact points is selected to minimize the wire edge angle between with the other of the contact points selected to minimize the wire free span. In this way, edge banding and strobing effects are minimized.

U.S. Pat. No. 5,204,719 discloses an apparatus in which an electrostatic latent image recorded on a photoconductive member is developed with toner. A donor roll, spaced from the photoconductive member, transports toner to a development zone adjacent the photoconductive member, an electrode member is positioned in the development zone between the photoconductive member and the donor. The electrode member is electrically biased to detach toner from the donor roll so as to form a toner cloud in the space between the electrode wires and the photoconductive member. In this way, the toner from the donor cloud develops the latent image recorded on the photoconductive member. A DC current is transmitted through the electrode member. A magnetic member interacts with the DC current flowing through the electrode member to substantially dampen vibrations of the electrode member.

According to the present invention, there is provided a developer unit for developing a latent image recorded on an image receiving member with marking particles, to form a developed image. The unit comprises a donor member spaced from the image receiving member and adapted to transport marking particles to a development zone adjacent the image receiving member and an electrode positioned in the development zone between the image receiving member and the donor member. The developer unit also comprises a biaser for electrically biasing the electrode with an alternating current having a frequency varying with time, so as to minimize natural frequency resonant vibrations of the electrode and to detach marking particles from the donor member forming a cloud of marking particles in the development zone with detached marking particles from the cloud of marking particles developing the latent image.

According to the present invention, there is also provided an electrophotographic printing machine of the type having an electrostatic latent image recorded on a photoconductive member developed with toner. The machine comprises a donor member spaced from the image receiving member and adapted to transport marking particles to a development zone adjacent the image receiving member and an electrode positioned in the development zone between the image receiving member and the donor member. The developer unit also comprises a biaser for electrically biasing the electrode with an alternating current having a frequency varying with time, so as to minimize natural frequency resonant vibrations of the electrode and to detach marking particles from the donor member forming a cloud of marking particles in the development zone with detached marking particles from the cloud of marking particles developing the latent image.

There is further provided a method of developing a latent image recorded on an image receiving member with marking particles, to form a developed image. The method comprises the steps of transporting marking particles on a donor member to a development zone adjacent the image receiving member and electrically biasing an electrode in the development zone with an alternating current having a frequency varying with time to detach marking particles from the donor member so as to form a cloud of marking particles in the development zone with detached marking particles developing the latent image and minimizing natural frequency resonant vibrations of the electrode.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 4 printing machine will be shown hereinafter schematically and their operation described briefly with reference thereto.

Figure 4:
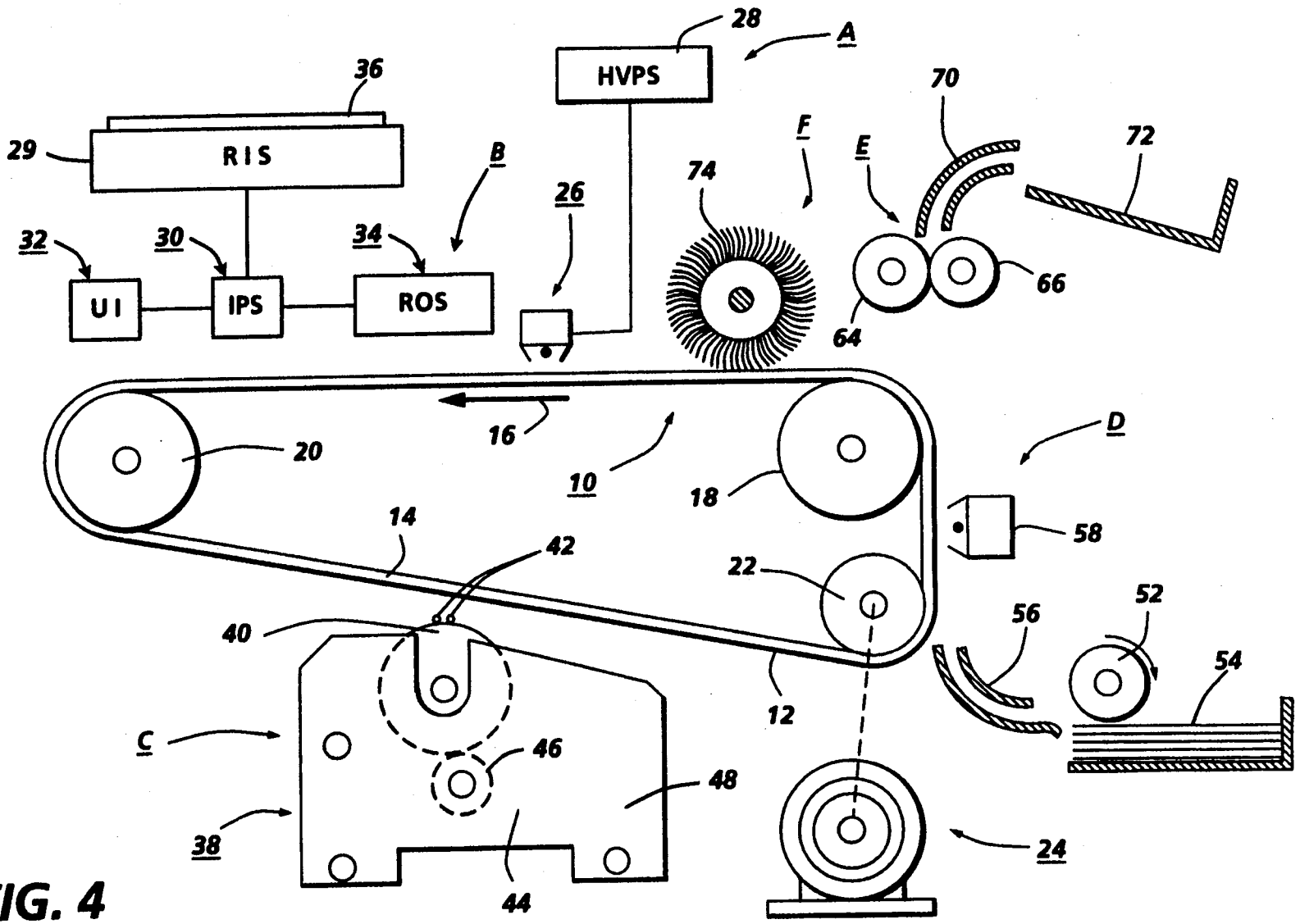
FIG. 4 is a schematic elevational view of an illustrative electrophotographic printing machine incorporating the modulated frequency AC voltage applied to the electrode wires of the development apparatus of the present invention therein.

Referring initially to FIG. 4, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably the surface layer 12 is made from a selenium alloy. The substrate 14 is preferably made from an aluminum alloy which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, potential. A high voltage power supply 28 is coupled to generator 26. After charging, the charged area of surface 12 is passed to exposure station B.

Next, the charged portion of photoconductive surface 12 is advanced through exposure station B. At exposure station B, an original document 36 is positioned on a raster input scanner (RIS), indicated generally by the reference numeral 29. The RIS contains document illumination lamps, optics, a mechanical scanning drive, and a charge coupled device (CCD array). The RIS captures the entire original document and converts it to a series of raster scan lines and (for color printing) measures a set of primary color densities, i.e., red, green and blue densities at each point of the original document. This information is transmitted to an image processing system (IPS), indicated generally by the reference numeral 30. IPS 30 is the control electronics which prepare and manage the image data flow to raster output scanner (ROS), indicated generally by the reference numeral 34. A user interface (UI), indicated generally by the reference numeral 32, is in communication with the IPS. The UI enables the operator to control the various operator adjustable functions. The output signal from the UI is transmitted to IPS 30. The signal corresponding to the desired image is transmitted from IPS 30 to ROS 34, which creates the output copy image. ROS 34 lays out the image in a series of horizontal scan lines with each line having a specified number of pixels per inch. The ROS includes a laser having a rotating polygon mirror block associated therewith. The ROS exposes the charged photoconductive surface of the printer.

After the electrostatic latent image has been recorded on photoconductive surface 12, belt 10 advances the latent image to development station C as shown in FIG. 4. At development station C, a development system 38, develops the latent image recorded on the photoconductive surface. Preferably, development system 38 includes a donor roller 40 and electrode wires 42 positioned in the gap between the donor roller 40 and photoconductive belt 10. Electrode wires 42 are electrically biased relative to donor roller 40 to detach toner therefrom so as to form a toner powder cloud in the gap between the donor roll and photoconductive surface. The latent image attracts toner particles from the toner powder cloud forming a toner powder image thereon. Donor roller 40 is mounted, at least partially, in the chamber of developer housing 44. The chamber in developer housing 44 stores a supply of developer material 48. The developer material is a two component developer material of at least magnetic carrier granules having toner particles adhering triboelectrically thereto. A transport roller 46 disposed interiorly of the chamber of housing 44 conveys the developer material to the donor roller 40. The transport roller 46 is electrically biased relative to the donor roller so that the toner particles are attracted from the transport roller to the donor roller.

Again referring to FIG. 4, after the electrostatic latent image has been developed, belt 10 advances the developed image to transfer station D, at which a copy sheet 54 is advanced by roll 52 and guides 56 into contact with the developed image on belt 10. A corona generator 58 is used to spray ions on to the back of the sheet so as to attract the toner image from belt 10 the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual toner particles adhering to photoconductive surface 12 are removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 1:
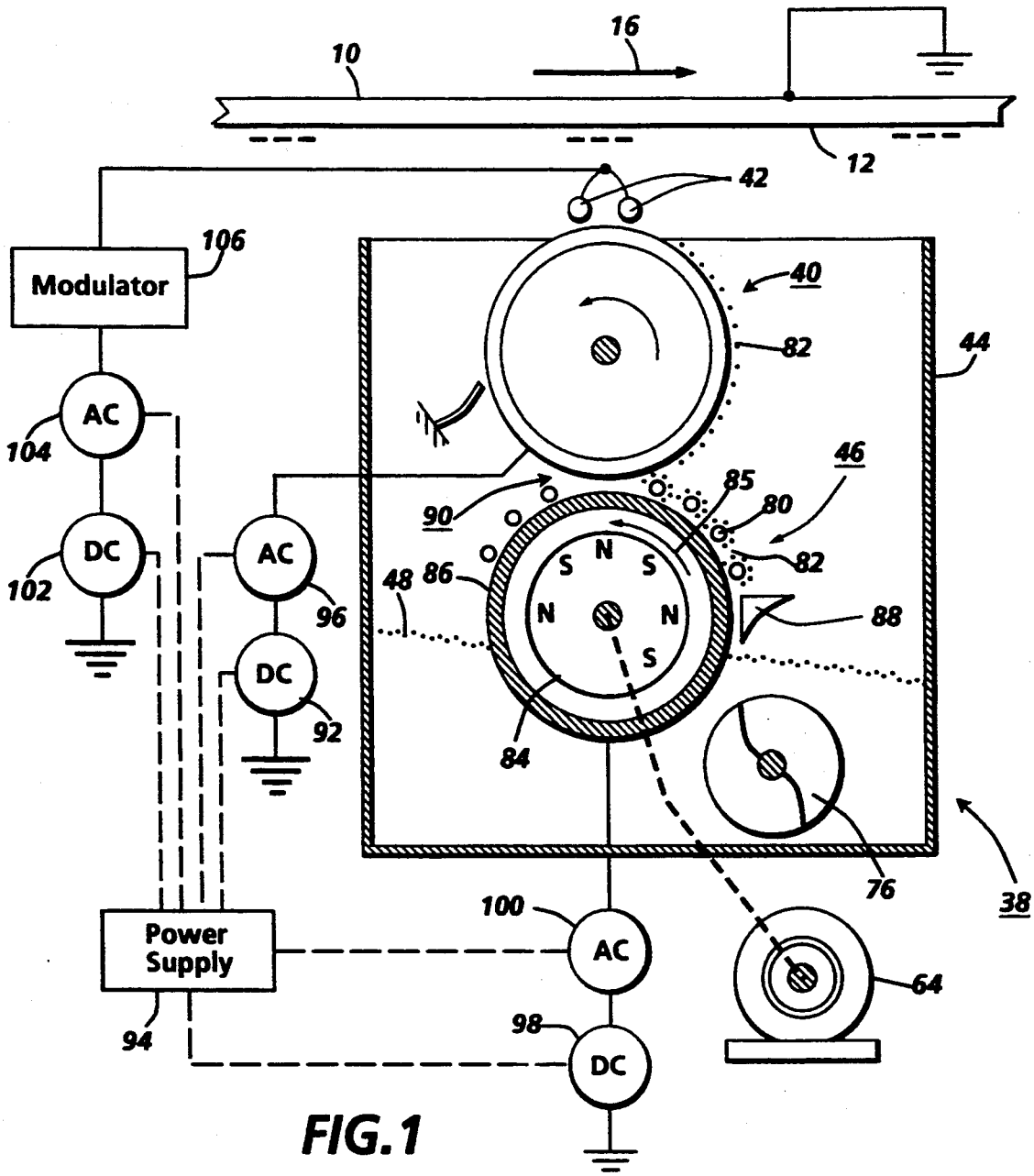
FIG. 1 is a schematic elevational view showing a development apparatus of the present invention.

Referring to FIG. 1, there is shown development system 38 in greater detail. Housing 44 defines a chamber for storing a supply of developer material 48 therein. The developer material includes carrier granules 80 having toner particles 82 adhering triboelectrically thereto. Positioned in the bottom of housing 44 is a horizontal auger 76 which distributes developer material 48 uniformly along the length of transport roller 46 in the chamber of housing 44.

Transport roller 46 comprises a stationary multi-pole magnet 84 having a closely spaced sleeve 86 of non-magnetic material, preferably aluminum, designed to be rotated about the magnet 84 in a direction indicated by arrow 85. Because the developer material 48 includes magnetic carrier granules 80, the effect of the sleeve 86 rotating through stationary magnetic fields is to cause developer material 48 to be attracted to the exterior of the sleeve 86. A doctor blade 88 meters the quantity of developer adhering to sleeve 86 as it rotates to a loading zone 90, the nip between transport roller 46 and donor roller 40.

The donor roller is kept at a specific voltage, by a DC voltage source 92 supplied by a DC power supply 94 to attract a layer of toner particles 82 from transport roller 46 to donor roller 40 in the loading zone 90.

An AC voltage source 96 may also be connected to the donor roller 40. The effect of the AC electrical field applied along the donor roller in nip 90 is to loosen the toner particles 82 from their adhesive and triboelectric bonds to the carrier particles 80. Either the whole of the donor roller 40, or at least a peripheral layer thereof, is preferably of material which has low electrical conductivity. The material must be sufficiently conductive to prevent any build-up of electric charge with time, and yet its conductivity must be sufficiently low to form a blocking layer to prevent shorting or arcing of the magnetic brush to the donor roller.

Transport roller 46 is biased by both a DC voltage source 98 and an AC voltage source 100. The effect of the DC electrical field is to enhance the attraction of developer material to sleeve 86. It is believed that the effect of the AC electrical field applied along the transport roller in nip 90 is to loosen the toner particles from their adhesive and triboelectric bonds to the carrier particles.

While the development system 38 as shown in FIG. 1 utilizes donor roller DC voltage source 92 and AC voltage source 96 as well as transport roller DC voltage source 98 and AC voltage source 100, the invention may be practiced, with merely DC voltage source 92 on the donor roller.

It has been found that a value of up to 200 $V_{rms}$ is sufficient for the output of source 100 for the desired level of reload efficiency of toner particles to be achieved. The actual value can be adjusted empirically. In theory, the value can be any value to a maximum voltage of about 400 $V_{rms}$. The source should be at a frequency of about 2 kHz. If the frequency is too low, e.g. less than 200 Hz, banding will appear on the copies. If the frequency is too high, e.g. more than 15 kHz, the system would probably work but the electronics may become expensive because of capacitive loading losses.

Electrode wires 42 are disposed in the space between the belt 10 and donor roller 40. A pair of electrode wires are shown extending in a direction substantially parallel to the longitudinal axis of the donor roller 40. The electrode wires are made from one or more thin (i.e. 50 to 100 μm diameter) stainless steel wires which are closely spaced from donor roller 40. The distance between the wires and the donor roller 40 is approximately 25 μm or the thickness of the toner layer formed on the donor roller 40. The wires are self-spaced from the donor roller by the thickness of the toner on the donor roller. To this end the extremities of the wires supported by the tops of end bearing blocks also support the donor roller for rotation. The wire extremities are attached so that they are slightly below a tangent to the surface, including toner layer, of the donor structure. Mounting the wires in such a manner makes them insensitive to roll runout due to their self-spacing.

While a pair of wires is shown, the invention may be practiced with any number of wires including three or four wires. The wires, based on their length, diameter, tension, and material composition, and to a lesser extent the rigidity of the frame to which they are mounted, have a natural frequency, $V_n$, that can be described by the formula:

$$V_n=(n/21)*(F/\mu)^{\frac{1}{2}}$$

where:

n=number of loops or the harmonic number

I=length of the wire

F=tension of the wire

μ=mass per unit length of the wire

To effectuate powder cloud development, an AC bias is applied to the wires 42. The AC bias establishes an alternating electrostatic field between the wires 42 and the donor roller which is effective in detaching toner from the surface of the donor roller and forming a toner cloud about the wires, the height of the cloud being such as not to be substantially in contact with the belt 10.

As earlier stated, if an AC bias in which the frequency of the AC bias is the same as the natural frequency of the wires is applied to the wires, the wires will begin to become excited and to eventually excessively vibrate and break. In order for the wires to excessively vibrate the AC bias frequency and the natural frequency must be the same for a sufficient period of time to sufficiently excite the wires. If the amount of time the frequencies match is short, i.e. less than 0.01 second, the wires will not become excessively excited and break.

If the AC bias is applied to the wires 42 with a frequency that varies with time with a frequency of approximately 100 Hz or more, the wires 42 will not be excessively excited. An AC bias that varies with a frequency of at least 100 Hz has been found to be satisfactory.

According to the present invention, and referring again to FIG. 1, the developer unit preferably includes a DC voltage source 102 to provide proper bias to the wires 42 relative to the donor roller 40. The invention may nonetheless operate with some success without the DC voltage source 102. An AC voltage source 104 is connected to a modulator for modulating the frequency of the alternating current transmitted from the AC voltage source 104. The output of source 104 is preferably at least 100 HZ. The modulated frequency alternating current signal from the modulator 106 is electrically connected to the wires 42. The modulator 106 may be any suitable commercially available suitable device such as one including a frequency generator.

While in the development system 38, as shown in FIG. 1, the AC voltage source 104 and the DC voltage source 102 receive their power from the power supply 94, the power may likewise be received from separate power supplies. Also, the DC voltage source 102 may be separate from the DC voltage sources 92 and 98 as shown in FIG. 1 or share a common voltage source. Further, the AC voltage source 104 may be separate from the AC voltage sources 96 and 100 as shown in FIG. 1 or share a common voltage source. Also, modulator 106 may merely modulate the signal from the AC voltage source 104 as shown in FIG. 1 or modulate either or both the AC voltage sources 96 and 100.

The DC voltage source 102 may be electrically connected to the AC voltage source 104 as shown in FIG. 1 or directly connected to the wires.

Figure 2:
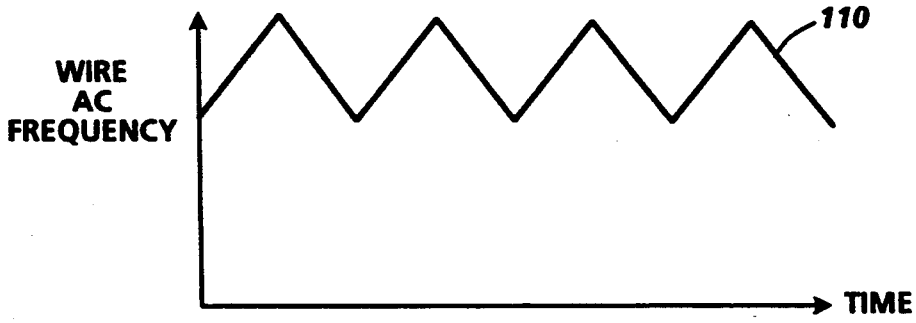
FIG. 2 is a graphical illustration of an illustrative wire AC frequency signal plotted versus time for the development apparatus of FIG. 1.

Referring now to FIG. 2, a suitable signal 110 from the modulator is shown graphically. While FIG. 2 depicts a linearly varying signal, or saw tooth signal, any shape of a signal in which the frequency varies over time may be used within the scope and spirit of the invention, including but not limited to sine waves. Preferably the signal should not have a slope with an angle $\alpha$ that approaches zero degrees, since such a signal would provide a slowly varying frequency signal over time.

Figure 3:
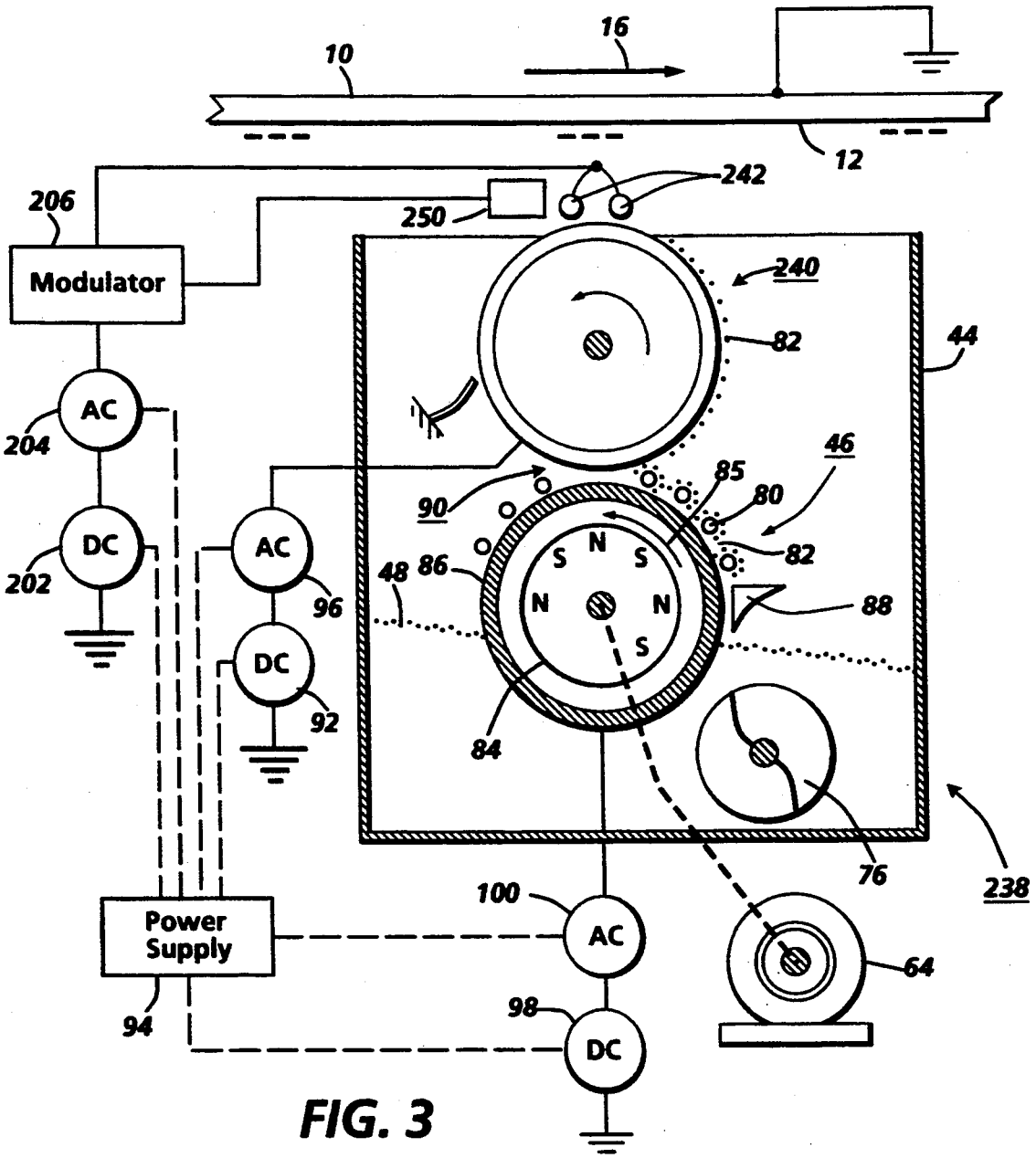
FIG. 3 is a schematic elevational view of another embodiment of a development apparatus according to the present invention.

While the embodiment of the invention shown in FIGS. 1 and 2 describe a system to reduce wire vibration with minimal hardware, an alternate embodiment is shown in FIG. 3. The development system 238 includes donor roller 240 which is similar to roller 40 of FIG. 1. The system 238 also includes electrode wires 242 which are similar to wires 42 of FIG. 1. DC and AC voltage sources 202 and 204, respectively, are electrically connected to modulator 206. Modulator 206, like modulator 106 of FIG. 1, modulates the frequency of AC voltage sources 204, but unlike modulator 106 which merely cycles the frequency in a varying pattern as shown in FIG. 2, the modulator 206 receives a signal from a sensor 250 which senses the vibration of the wire by any suitable means and sends a signal to the modulator to change the frequency of the electrical current being transmitted to electrode wires 242 if the wire vibration is above a predetermined amplitude level. This closed loop feature has the advantage of positively avoiding having the current transmitted to the wires 242 to correspond to the natural frequency thereof.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

I claim:

1. A developer unit for developing a latent image recorded on an image receiving member with marking particles, to form a developed image, comprising:

a donor member spaced from the image receiving member and adapted to transport marking particles to a development zone adjacent the image receiving member;

an electrode positioned in the development zone between the image receiving member and the donor member; and for electrically biasing said electrode during a developing operation with an alternating current having a frequency varying substantially continuously with time and independently of the instantaneous mechanical frequency of said electrode, so as to minimize natural frequency resonant vibrations of said electrode and to detach marking particles from said donor member forming a cloud of marking particles in he development zone with detached marking particles from the cloud of marking particles developing the latent image.

2. A developer unit according to claim 1, wherein said electrode comprises a plurality of electrode wires.

3. A developer unit according to claim 2, wherein the frequency of the alternating current varies sinusoidally.

4. A developer unit according to claim 2, wherein the frequency of the alternating current varies linearly.

5. A developer unit according to claim 2, wherein the frequency is at least 1000 hertz.

6. A developer unit according to claim 2, further comprising a sensor for sensing the vibrations of said plurality of electrode wires, said biasing means in response to the vibrations sensed by said sensor varying the frequency of the alternating current.

7. An electrophotographic printing machine of the type halting an electrostatic latent image recorded on a photoconductive member developed with toner, comprising;

a donor member spaced from the image receiving member and adapted to transport marking particles to a development zone adjacent the image receiving member;

an electrode positioned in the development zone between the image receiving member and the donor member; and means for electrically biasing said electrode during a developing operation with an alternating current having a frequency varying substantially continuously with time and independently of the instantaneous mechanical frequency of said electrode, so as to minimize natural frequency resonant vibrations of said electrode and to detach marking particles from said donor member forming a cloud of marking particles in he development zone with detached marking particles from the cloud of marking particles developing the latent image.

8. A printing machine according to claim 7, wherein said electrode comprises a plurality of electrode wires.

9. A printing machine according to claim 8, wherein the frequency of the alternating current varies sinusoidally.

10. A printing machine according to claim 8, wherein the frequency of the alternating current varies linearly.

11. A printing machine according to claim 8, wherein the frequency is at least 1000 hertz.

12. A printing machine according to claim 8, further comprising a sensor for sensing the vibrations of said plurality of electrode wires, said biasing means in response to the vibrations sensed by said sensor varying the frequency of the alternating current.

13. A method of developing a latent image recorded or an image receiving member with marking particles, to form a developed image, comprising the steps of:

transporting marking particles on a donor member to a development zone adjacent the image receiving member; and electrically biasing an electrode in the development zone during a developing operation with an alternating current having a frequency varying substantially continuously with time and independently of the instantaneous mechanical frequency of said electrode to detach marking particles from the donor member so as to form a cloud of marking particles in the development zone with detached marking particles developing the latent image and minimizing natural frequency resonant vibrations of the electrode.

14. A method of developing according to claim 13, wherein said step of electrically biasing comprises the step of varying the frequency of the alternating current sinusoidally with time.

15. A method of developing according to claim 13, wherein said step of electrically biasing comprises the step of varying the frequency of the alternating current linearly with time.

16. A method of developing according to claim 13, wherein said step of electrically biasing comprises applying the alternating current at a frequency of at least 1000 hertz.

17. A method of developing according to claim 13, further comprising the step of sensing vibration of the electrode, said step of electrical biasing varying the frequency of the alternating current in response to the vibration sensed during the sensing step.

* * * * *